US009708098B2

(12) United States Patent
Plott et al.

(10) Patent No.: US 9,708,098 B2
(45) Date of Patent: Jul. 18, 2017

(54) FULLY EVERSIBLE BEVERAGE RECEPTACLE

(71) Applicants: Jeffrey Stephen Plott, Algonac, MI (US); Christopher John Plott, Algonac, MI (US)

(72) Inventors: Jeffrey Stephen Plott, Algonac, MI (US); Christopher John Plott, Algonac, MI (US)

(73) Assignee: flipsi ltd., Ann Arbor, MI (US)

( * ) Notice: Subject to any disclaimer, the term of this patent is extended or adjusted under 35 U.S.C. 154(b) by 0 days.

(21) Appl. No.: 14/313,961

(22) Filed: Jun. 24, 2014

(65) Prior Publication Data

US 2014/0305943 A1 Oct. 16, 2014

Related U.S. Application Data

(63) Continuation-in-part of application No. 13/751,092, filed on Jan. 27, 2013, now abandoned.
(Continued)

(51) Int. Cl.
*A61J 9/00* (2006.01)
*B65D 21/08* (2006.01)
(Continued)

(52) U.S. Cl.
CPC ..... *B65D 21/086* (2013.01); *A61J 9/001* (2013.01); *A61J 9/005* (2013.01);
(Continued)

(58) Field of Classification Search
CPC ..... B65D 1/42; B65D 21/086; B65D 83/005; B65F 2220/1066; B65F 2250/12; A61J 9/001; A61J 9/005; A61J 9/08
(Continued)

(56) References Cited

U.S. PATENT DOCUMENTS 985,328 A * 2/1911 Decker ..... 215/11.6
2,508,481 A * 5/1950 Allen ..... 215/11.3
(Continued)

FOREIGN PATENT DOCUMENTS

JP 2003-062046 A 3/2003
JP 2003-093477 4/2003
(Continued)

OTHER PUBLICATIONS

Tlgex—Reversible Cup (http://www.tigex.com/uk/content/reversible-cup) web site page printed Jan. 17, 2012.

*Primary Examiner* — Jeffrey Allen
*Assistant Examiner* — Jennifer Castriotta
(74) *Attorney, Agent, or Firm* — Wayne State Law School Patent Procurement Clinic; David C. Berry

(57) ABSTRACT

A receptacle has at least one elastomeric sidewall with a contoured non-linear shape defining a container with a predetermined volume for housing a substance to be contained. The at least one sidewall includes a substance-contacting surface. The receptacle is fully reversibly eversible to transform between a first stable conformation with the substance-contacting surface facing inward and a second stable conformation with the substance-contacting surface facing outward allowing for facile cleaning and drying of the substance-contacting surface. The at least one elastomeric sidewall possesses sufficient structural strength to stand upright in the first and second stable conformations without extraneous support. The receptacle can include a cap and an attachment joint for securing the cap to the elastomeric receptacle.

11 Claims, 10 Drawing Sheets

Related U.S. Application Data

(60) Provisional application No. 61/838,843, filed on Jun. 24, 2013.

(51) Int. Cl.
*A45F 3/20* (2006.01)
*A61J 9/08* (2006.01)
*A47G 19/22* (2006.01)

(52) U.S. Cl.
CPC .... *A45F 2003/205* (2013.01); *A47G 19/2266* (2013.01); *A61J 9/085* (2013.01)

(58) Field of Classification Search
USPC ..... 220/737, 742, 8, 4.28, 666, 672, 495.06; 215/11.3, 11.1–11.6, 900
See application file for complete search history.

(56) References Cited

U.S. PATENT DOCUMENTS 2,599,630 A * 6/1952 Hair ..... 215/11.3
2,697,531 A 12/1954 Hood
3,143,429 A * 8/1964 Swanson et al. ..... 426/117
3,220,544 A * 11/1965 Lovell ..... 206/218
3,232,467 A * 2/1966 Barton ..... A61J 9/001 215/11.1
3,292,809 A * 12/1966 Shomock et al. ..... 215/11.5
3,851,781 A * 12/1974 Marco ..... A61J 9/001 215/11.3
4,383,564 A 5/1983 Hoie
4,678,092 A * 7/1987 Rane ..... 215/11.3
4,813,556 A 3/1989 Lawrence
4,986,428 A * 1/1991 Signorini ..... 215/11.3
5,197,658 A 3/1993 Sprunger
5,201,438 A 4/1993 Norwood
5,209,372 A 5/1993 Norwood
5,255,808 A 10/1993 Tobler
5,332,111 A * 7/1994 Bowen ..... 215/395
5,356,016 A * 10/1994 Wiedemann ..... A61J 9/001 215/11.1
5,384,138 A * 1/1995 Robbins et al. ..... 426/111
5,407,093 A 4/1995 McGill
5,439,128 A * 8/1995 Fishman ..... 220/8
5,591,110 A 1/1997 Weissbuch
5,758,787 A * 6/1998 Sheu ..... 215/11.1
5,765,715 A * 6/1998 Hughes ..... 220/737
5,878,899 A * 3/1999 Manganiello ..... A61J 9/001 215/11.1
5,921,431 A * 7/1999 Pych ..... 220/742
6,248,296 B1 * 6/2001 Butcher ..... 422/128
6,616,000 B1 * 9/2003 Renz ..... 215/11.1
6,662,964 B2 12/2003 Higuchi
6,737,091 B1 * 5/2004 Littell, II ..... 426/117
6,948,616 B2 9/2005 Gillani
7,210,591 B2 * 5/2007 Goldman et al. ..... 215/11.1
7,506,754 B2 * 3/2009 Segovia et al. ..... 206/219
7,517,933 B2 * 4/2009 Holmes et al. ..... 524/588
7,607,348 B2 * 10/2009 Law ..... 73/427
7,802,691 B2 9/2010 Musalek
7,819,263 B1 * 10/2010 DiCarlo-Nelson ..... 215/11.3
7,938,281 B2 * 5/2011 Horntrich et al. ..... 215/11.6
8,020,507 B2 * 9/2011 Strong ..... 116/308
8,100,276 B2 * 1/2012 Moor ..... 215/11.3
8,186,391 B2 5/2012 Wilson
8,267,271 B2 * 9/2012 Faris ..... 220/8
8,397,926 B2 * 3/2013 Driver et al. ..... 215/11.3
2004/0013030 A1 * 1/2004 Renz ..... 366/130
2004/0045841 A1 * 3/2004 Segovia et al. ..... 206/219
2005/0127073 A1 * 6/2005 Kusuma et al. ..... 220/6
2006/0277994 A1 * 12/2006 Peterson ..... 73/426
2007/0181520 A1 * 8/2007 Holley et al. ..... 215/11.1
2008/0041807 A1 * 2/2008 Tominaga ..... 215/11.3
2009/0108009 A1 * 4/2009 Yeung ..... 220/737
2009/0183565 A1 * 7/2009 Shamoon et al. ..... 73/426
2010/0193460 A1 * 8/2010 Driver et al. ..... 215/11.3
2013/0243909 A1 * 9/2013 Joyce ..... 426/106
2013/0284753 A1 * 10/2013 Kellmann ..... 220/666

FOREIGN PATENT DOCUMENTS

KR 2011024959 A 3/2011
WO 2010/121800 A1 10/2010
WO 2012/115491 A2 8/2012
WO 2012/115491 A3 8/2012

* cited by examiner

FULLY EVERSIBLE BEVERAGE RECEPTACLE

FIELD OF THE INVENTION

This invention relates to receptacles, such as beverage receptacles, which are constructed substantially of an elastomeric material such that the receptacles are fully eversible and resilient.

BACKGROUND

Beverage receptacles can be difficult to clean, as an inherent consequence of the basic shape requirements. In particular, the beverage contacting surface is not amenable to manual washing, as the interior surface is recessed and difficult to contact. This is particularly the case for beverage receptacles which often contain powdered drinks, such as baby formula or protein powder. Nursing bottles, for example, often need to be washed with an extended scrubbing brush which is capable of accessing the inner recesses of the receptacle. Failure to properly clean the inner portion of a beverage receptacle can result in microbiotic growth, and illness for subsequent users of the receptacle.

Various solutions to these problems have been proposed by those skilled in the art. For example, see U.S. Published Application No. 2009/0108009; Japanese Published Application No. JP200393477; PCT Published Application No. WO2012/115491; Korean Publication No. 1020110024959; U.S. Pat. No. 8,267,271; U.S. Pat. No. 5,591,110; PCT Published Application No. WO2010/121800; and a commercialized product sold under the name of TIGEX (http://www.tigex.com/uk/content/reversible-cup). While each of these products appears suitable for its intended purpose, none of these configurations provide a satisfactory solution to the need for a simple and effective way to expose an interior surface of a container for cleaning and drying purposes. Thus, there has been a long felt, unresolved need for a receptacle which provides facile access to, washability and drying of, the inner, or beverage-contacting, surface.

SUMMARY

A beverage receptacle for easy cleaning and drying can include at least one sidewall contoured to define an open end. The sidewall can be manufactured substantially of an elastomeric material, such that the receptacle can be fully eversible as well as resilient. The receptacle can be transformed, via eversion, between two stable conformations. The first stable conformation can be suitable for containing a beverage, or other substance, and the second stable conformation can expose the beverage contacting surface, thereby facilitating cleaning and drying. The receptacle can be resilient, having the capability of maintaining shape in either stable conformation. When in the first stable conformation, the receptacle can be capable of standing upright without assistance.

A receptacle for containing a substance can include at least one sidewall defining a container with a predetermined volume for housing the substance to be contained. The at least one sidewall can include a first substance-contacting surface. The container can be reversibly eversible, such that the container reversibly transforms between a first stable conformation with the substance-contacting surface facing inward and a second stable conformation with the substance-contacting surface facing outward. A rigid sleeve can at least partially sheath the container and have at least one sidewall-pull-down cutout removing a portion of the sleeve allowing for a second surface of the sidewall to be exposed when in the first stable conformation. The at least one sidewall can be accessed during eversion to facilitate interaction of the at least one sidewall with respect to the sleeve.

A receptacle for containing a substance can include at least one elastomeric sidewall defining a container having a first surface. The container can be reversibly eversible between first and second stable conformations. The first stable conformation can be defined by the first surface facing inward and the second stable conformation can be defined by the first surface facing outward. The at least one elastomeric sidewall can have resilience and sufficient yield strain to prevent permanent deformation and fatigue failure of the elastomeric sidewall after repeated eversions. A rigid sleeve can at least partially sheath the container and have at least one eversion cutout created in the sleeve allowing for a second surface of the sidewall to be exposed when in the first stable conformation. Pressure can be directly applied to the at least one elastomeric sidewall to additionally facilitate removal from the sleeve and eversion of the container.

A receptacle for containing a substance can include a container including a contiguous containment wall defining an open end. The contiguous containment wall can have a first surface. The containment wall can be composed substantially of an elastomeric material. The containment wall can be reversibly eversible to transform between a normal stable conformation with the first surface facing inward and an everted stable conformation with the first surface facing outward. A buckle region of the containment wall can extend at least partially along a periphery of the container adjacent a lower portion of the container allowing the buckle region to strategically deform making eversion of the container easier. A rigid sleeve can at least partially sheath the container.

The buckle region (26*a*) can include a decoupling point defined by at least one protrusion extending outward from the second surface when the container is in the first stable conformation. A decoupling ledge can be formed on the sleeve mating with the at least one protrusion when the container is in the first stable conformation.

The sleeve can include at least one eversion cutout created in the sleeve allowing for a second surface of the containment wall to be exposed. Pressure can be directly applied to the containment wall to additionally facilitate in eversion. At least one containment-wall-pull-down cutout can remove at least a portion of the sleeve allowing for the second surface of the containment wall to be exposed. The at least one containment-wall-pull-down cutout allows the containment wall to be accessed through the sleeve during assembly and disassembly of the containment wall with respect to the sleeve during eversion to facilitate interaction of the containment wall with respect to the sleeve.

The sleeve can define an interstitial space between the sleeve and a second surface of the containment wall allowing stagnant air to be trapped therebetween to provide insulation.

A capping element can be provided to reversibly cover an open end of the receptacle. The capping element can be reversibly joined to the open end of the receptacle by an attachment joint to create a fluid tight seal between the open end of the receptacle and the capping element. The receptacle can sometimes be referred to herein as a "container" or a "containment element".

The receptacle can define an easily cleanable nursing bottle, including an eversible sidewall forming the receptacle, a nipple shaped capping element, and an attachment member. The receptacle, when in the first stable conformation, can be filled with a fluid or liquid such as milk or baby formula, and the nipple can be reversibly attached to the receptacle for drinking. When the receptacle is emptied of fluid or liquid contents, the nipple can be removed from the receptacle and the receptacle can be everted to the second stable conformation. The beverage contacting surface can then be easily and thoroughly cleaned, e.g. with a soapy sponge.

The containment element can also define an easily cleaned or dried general use beverage receptacle, such as can be used for a sports drink or a protein shake. The beverage receptacle can include an eversible receptacle, a rigid cap with a drinking opening, and an attachment member. Additional features can be included on the attachment member, bottle, or both to increase the ease of eversion. These features can be applied to all bottle types inclusively.

Other applications of the present invention will become apparent to those skilled in the art when the following description of a possible mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1C:
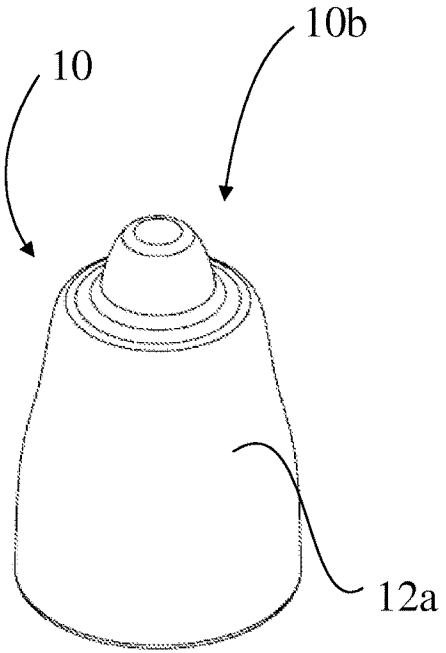
FIG. 1C is a perspective view of a receptacle in a second stable conformation after undergoing eversion.

Referring now to FIGS. 1A-9, a receptacle 10 is disclosed and illustrated to be more amenable to interior cleaning and drying than a typical receptacle. In particular, the receptacle 10 can include at least one sidewall 12 defining an open end 14, where the receptacle 10 is designed to surround and contain a fluid beverage or other material. The receptacle 10 is eversible, wherein the term "eversible" is used herein to describe a receptacle capable of being reversibly "turned inside out", transforming the receptacle 10 between a material holding conformation 10*a* and an everted conformation 10*b* for ease of cleaning and drying "interior" surfaces 12*a* of the material holding conformation. In other words, the everted conformation of the receptacle 10 enables facile cleaning and drying of a first surface 12*a* which is interior in the material holding conformation opposite from an "exterior" or second surface 12*b* which faces outwardly in the material holding conformation 10*a*. The receptacle 10 can be composed substantially of a material which possesses a sufficient Young's modulus and sidewall 12 thicknesses to avoid substantial transient deformation of the sidewall 12 under the force of weight of the receptacle 10.

The term "receptacle", as used herein, can refer to a container including at least one sidewall 12 defining at least one open end 14. The container or receptacle 10 can be capable of partly surrounding and thereby containing a material or substance. The material or substance so contained can be a liquid, such as a beverage or other liquid, a solid, a gas, or any mixture or other combination of solid, liquid, and/or gas, or any intermediate states thereof. The receptacle 10 can be eversible. When a substance contacts the first surface 12*a* of the receptacle 10 when the receptacle 10 is in the first stable state 10*a*, the receptacle can be said to be containing the substance or housing the substance.

The term "eversible" as used herein, can be defined as the receptacle being completely "turned inside out". The term "eversible" as used herein, can be further defined as the receptacle 10 being reversibly transformable between two stable conformations, wherein an interior surface and an exterior surface are reversed with respect to one another. In the first stable conformation 10*a*, the receptacle can have a material contacting surface 12*a* facing inward, and a second surface 12*b* facing outward. In the second stable conformation, the material contacting surface 12*a* faces outward, and the second surface 12*b* faces inward. Any transformation of the receptacle 10 from the first stable state 10*a* to the second stable state 10*b*, or vice versa, can be referred to as an eversion. Any multiplicity of such eversions can be referred to as repeated eversions.

The receptacle 10 can also be resilient. The term "resilient", as used herein, can be defined as the receptacle 10 being resistant to permanent deformation. The term "resilient" as used herein can be further defined as the receptacle 10 having a tendency to return to one of the two stable conformations, if deformed. The term "resilient" as used herein can further be defined as the receptacle 10 having a tendency to resist deformation, permanently or transiently, due to a weight of the receptacle 10. The resilience of the receptacle 10 can be described in terms of yield strain, which as used herein can be defined as the stress or force at which the sidewall 12 begins to deform.

Specifically, the sidewall material can be described in terms of fatigue failure. In such cases, the term "fatigue failure of the sidewall material" can refer to the situation where eversion, or repeated eversions, results in permanent deformation of the sidewall material. The receptacle 10 can also be described in terms of fatigue failure. The term "fatigue failure" as used herein, can refer to the situation where eversion, or repeated eversions, results in permanent deformation of the receptacle 10.

The term "capping element" 16, as used herein, can be defined as a physical structure reversibly engageable with the open end 14 of the receptacle 10. The capping element 16 at least partially covers the open end 14 of the receptacle 10, and at least partially inhibits the exit of any contained material from the receptacle 10. The capping element 16 can comprise at least one surface, wherein the surface is capable of being attached to the open end 14 of the receptacle. Such a surface can be referred to as an "attachable surface". When attachment of the capping element 16 to the open end 14 of the receptacle 10 results in formation of a fluid tight seal, it can be said that the receptacle is "sealingly engaging" the capping element.

The term "attachment member" 30, as used herein, is defined as at least one physical structure facilitating engagement of the capping element 16 to the open end 14 of the receptacle 10, or tending to inhibit disengagement of the capping element 16 from the engagement member 30.

The receptacle 10 can include a sidewall 12 made substantially of an elastomeric material. The term "elastomeric" is well known to those skilled in the art. As used herein, "elastomeric" or "elastomers" can include resilient polymeric materials having a Young's modulus of between approximately 1 megapascal (MPa) to approximately 7 megapascal (MPa), inclusive. Young's modulus, also known as tensile modulus or elastic modulus, also sometimes referred to as the modulus of elasticity, is a measure of stiffness of an elastic material. Young's modulus is defined as the ratio of the uniaxial stress over the uniaxial strain in the range of stress in which Hooke's law holds, which states that the displacement of a spring is in direct proportion with a load applied to the spring as long as the load does not exceed an elastic limit of the material. Young's modulus can be experimentally determined from the initial, linear slope portion of a stress-strain curve created during tensile tests conducted on a sample of the material. By way of example and not limitation, suitable elastomeric materials can include varieties of silicone, or thermoplastic elastomer (TPE), or thermoplastic polyurethane (TPU), or latex rubber. Suitable varieties of silicone can include silicone rubber, liquid silicone rubber, fluorosilicone rubber, silicone-modified ethylene propylene rubber, silicone polyester resin, silicone alkyd resin, silicone epoxy resin, and any combinations thereof. When the sidewall 12 is made of an elastomeric material, this can be referred to as an elastomeric sidewall.

Figure 8:
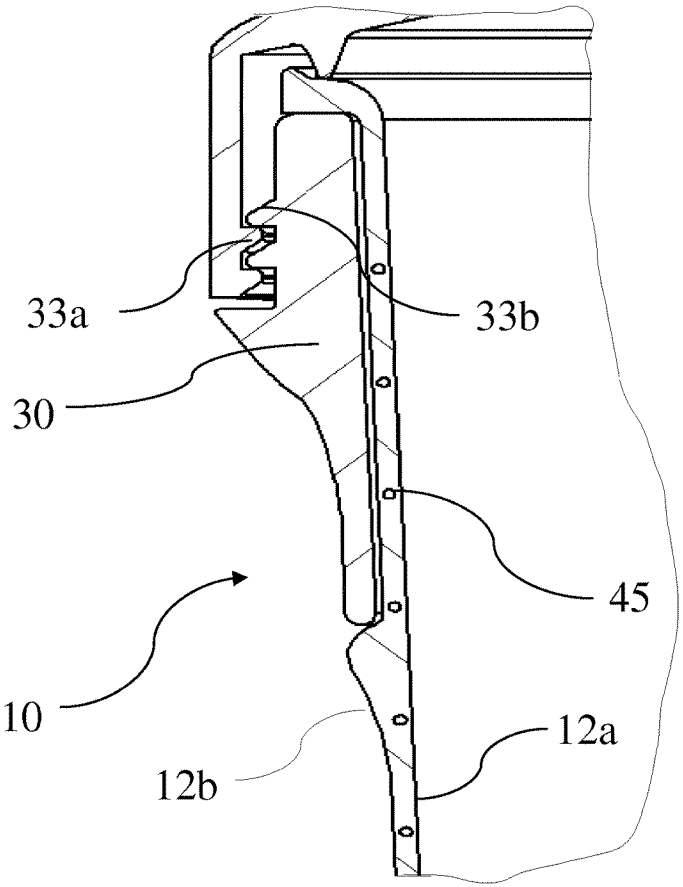
FIG. 8 is a detailed cross-sectional view of the receptacle of FIG. 7 including inserts of rigid material in the receptacle sidewall.

A capping element 16 can be made substantially of an elastomeric material. Alternatively, the capping element 16 can be made substantially of a rigid material. The term "rigid", as used herein, can be defined to refer to a material which does not deform during typical use, and can possess, but need not necessarily possess, a Young's modulus of greater than approximately 1 gigapascal (GPa), inclusive. The receptacle 10 as disclosed herein can be made substantially of an elastomeric material, and can include inserts 45, as best seen in FIG. 8, of a rigid or semi-rigid material. The term "semi-rigid", as used herein, is defined to refer to a material with a Young's modulus of greater than approximately 7 megapascal (MPa) and less than approximately 1 gigapascal (GPa), inclusive. The inserts 45 can be completely embedded within the receptacle sidewall 12 of the receptacle 10. Individual inserts can be annular in shape and can extend along an entire periphery or perimeter of the receptacle containment element. Inserts 45 can be included in any number, and with any spacing between inserts. By way of example and not limitation, the inserts can have equidistant spacing with respect to one another.

The receptacle 10 can include a sidewall 12 defining an open end 14, and an end wall 20 opposite the open end 14. Typically, the sidewall will be contiguous to, or directly adjoining the open end. If an end wall is present, it will typically be contiguous to, or directly adjoining the sidewall. The phrase "containment wall" can be used to refer to either the sidewall, or to the sidewall and the end wall together. The end wall 20 can include an indentation 22 in the end wall 20. The indentation 22 can extend inwardly with a conical shape or can include any other shape, by way of example and not limitation, such as semi-spherical, cylindrical, pyramidal, or trapezoidal. When the shape of the indentation is conical, it can be referred to as a "conical indentation". The end wall 20 can include an eversion handle 24. The term "eversion handle" 24, as used herein, is defined to refer to areas 24*a* of the sidewall 12 or end wall 20 possessing localized increased thickness relative to other portions of the sidewall 12 or end wall 20, and can be used for facilitating manual eversion of the receptacle 10.

Figure 6:
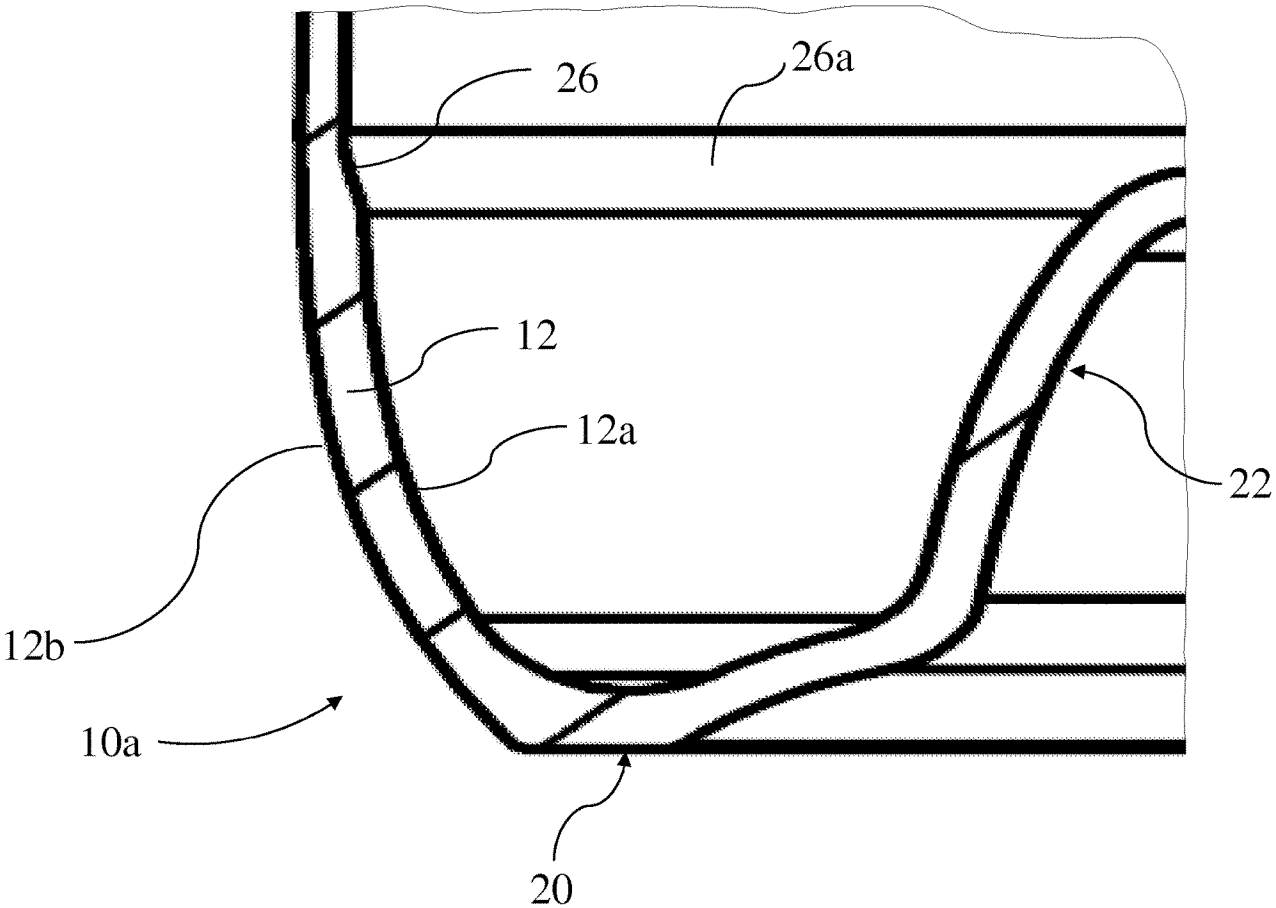
FIG. 6 is a detailed cross-sectional view of the receptacle of FIG. 1A in the first stable conformation.
Figure 11:
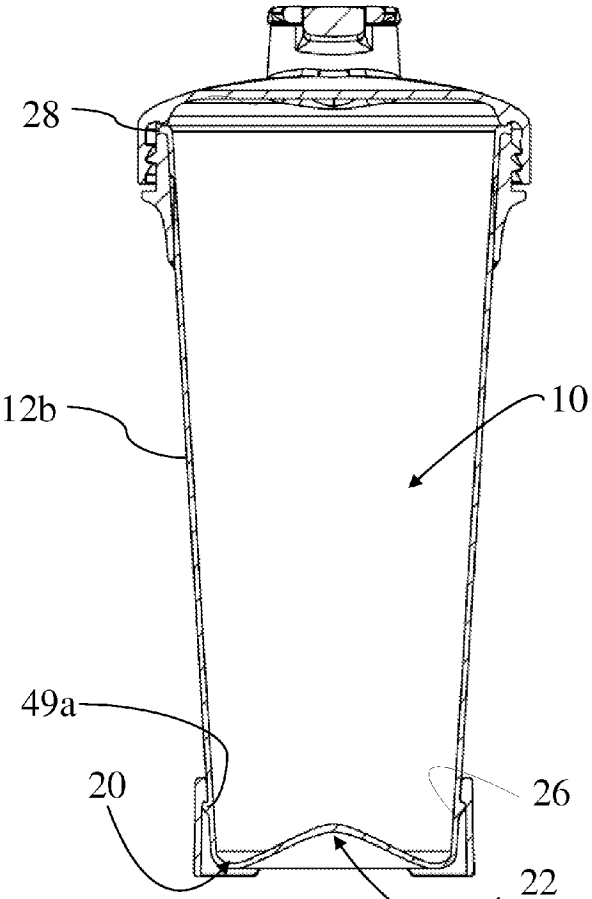
FIG. 11 is a cross-sectional view of the receptacle of FIG. 10 including eversion aiding cutouts in extended attachment member and a mating protrusion on the containment element to facilitate easier eversion of the containment element.
Figure 10:
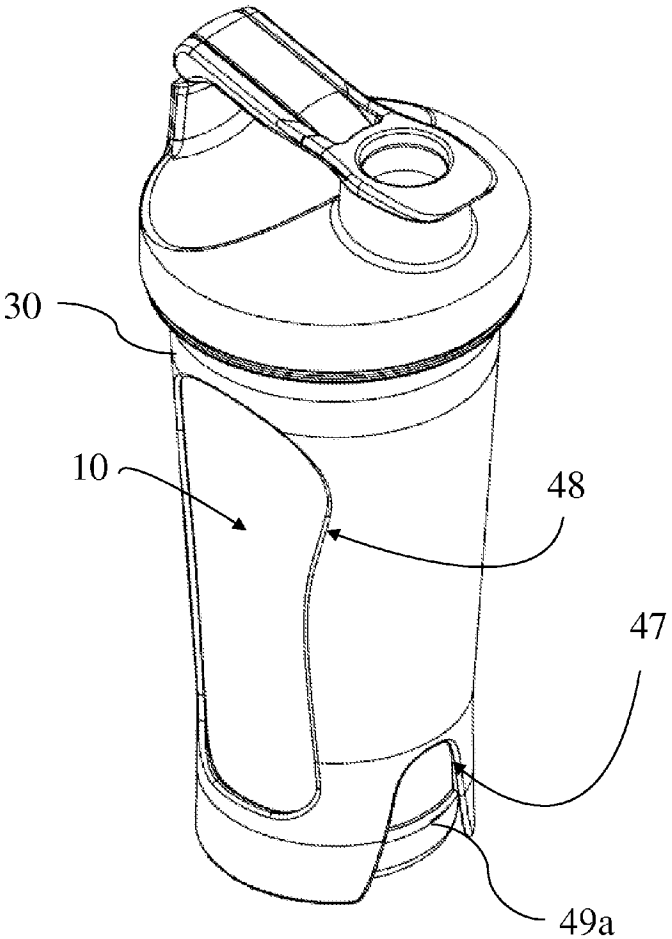
FIG. 10 is a perspective view of an additional embodiment of a general use bottle including a containment element, a rigid cap with an optional protruding aperture and reversible aperture cover, and an extended attachment member, having one sleeve, including cutouts and protrusion designed to facilitate easier eversion of the containment element.
Figure 13:
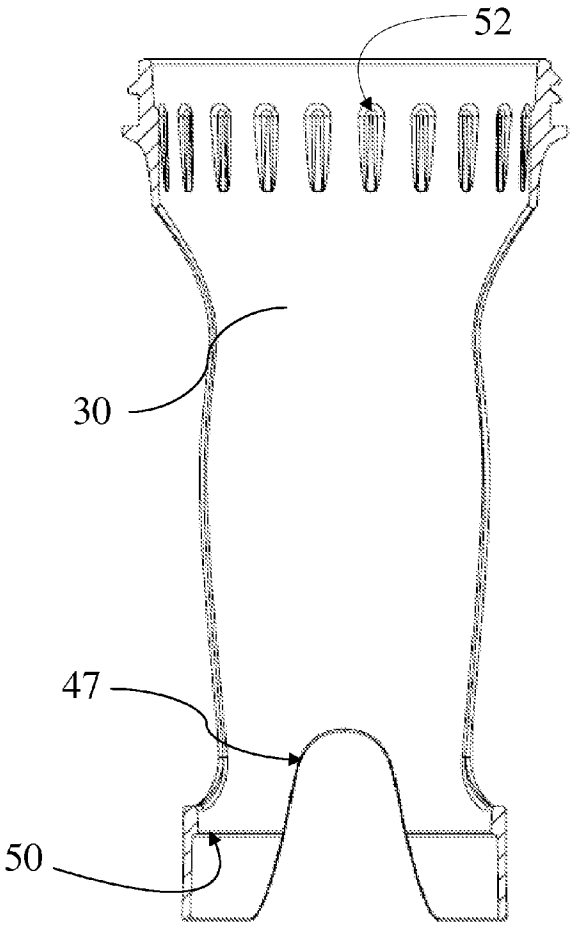
FIG. 13 is a cross-sectional view of the extended attachment member as shown in FIG. 10 including additional containment holding protrusions.
Figure 12:
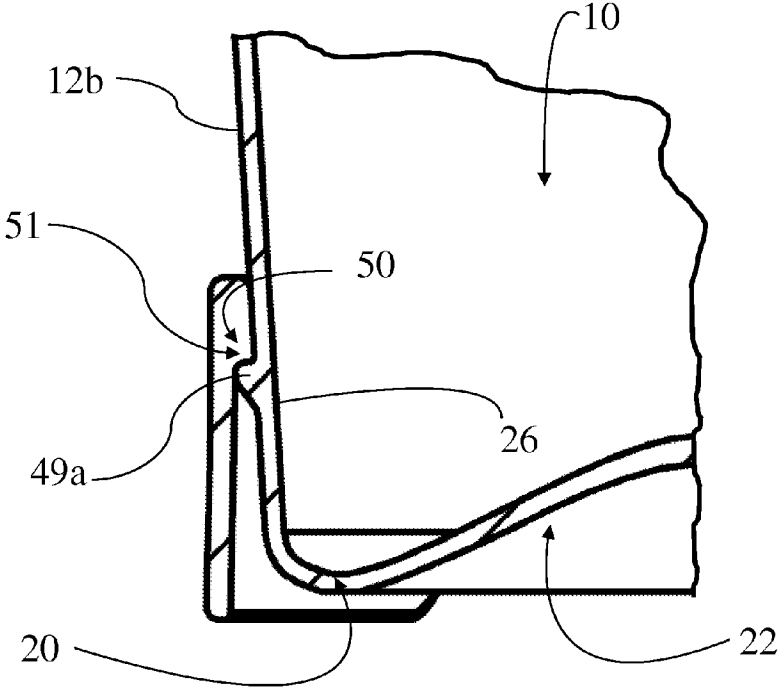
FIG. 12 is a detailed cross-sectional view of the receptacle of FIGS. 10 and 11 including eversion aiding cutouts in extended attachment member and a mating protrusion on the containment element to facilitate easier eversion of the containment element.
Figure 15:
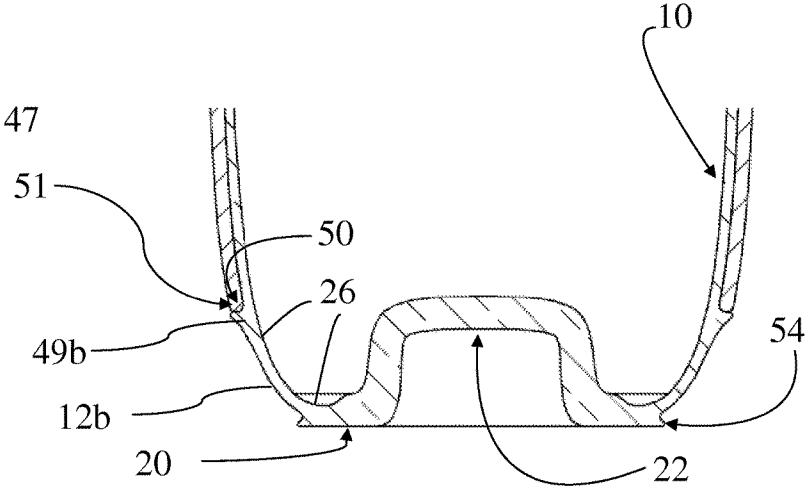
FIG. 15 is a detailed cross-sectional view of the receptacle in FIG. 14 including a containment element, eversion aiding cutouts, a mating protrusion, a nipple-shaped capping element, dome shaped cover, and an attachment member having two sleeves.
Figure 14:
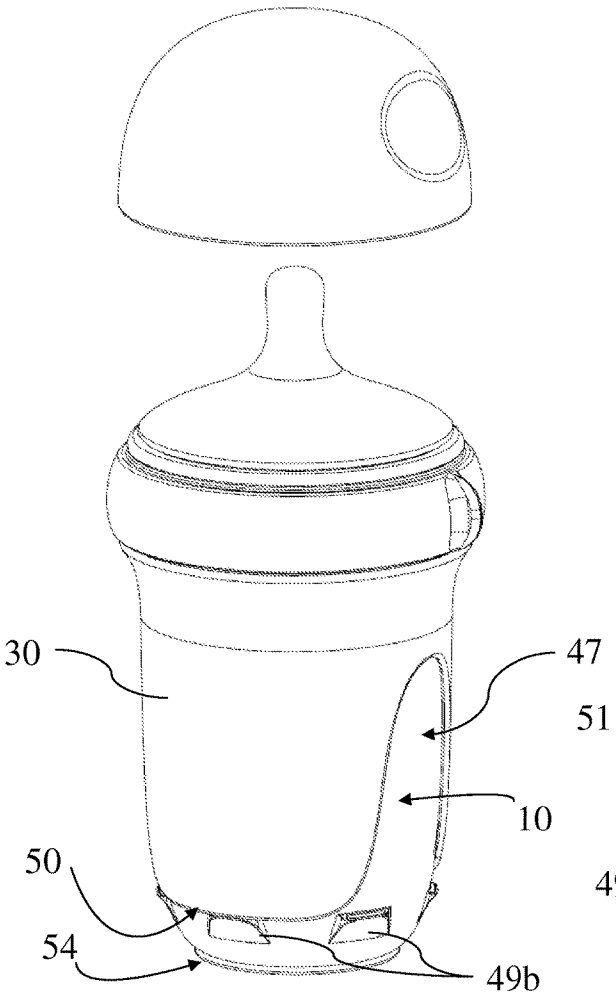
FIG. 14 is a perspective view of a nursing bottle including a containment element, eversion aiding cutouts, a mating protrusion, a nipple-shaped capping element, dome shaped cover, and an attachment member having two sleeves.

The receptacle 10 can include one or more buckle points 26, as best seen in FIGS. 6, 12, and 15, formed integrally with the sidewall 12. The term "buckle point" 26, as used herein, can be defined to refer to a designed in transition point to a decreased thickness region 26*a* relative to other portions of the sidewall 12 where the bottle will tend to strategically deform, making eversion easier. If one or more buckle points 26 are provided, the one or more buckle points 26 would tend to be a region 26*a*, as best seen in FIG. 6, first to deform during eversion of the receptacle 10. An additional embodiment of receptacle 10, as best seen in FIGS. 10-15, can include one or more buckle points 26, with a continuous annular protrusion 49*a* extending outwardly from the non-containing surface 12*b*, as best seen in FIGS. 10-12, or a discontinuous annular protrusion 49*b*, as best seen in FIGS. 14 and 15, both of which can mate contiguously or in an interrupted manner with decoupling ledge 50 on attachment member 30. A decoupling ledge 50 can be placed on the sidewall of engagement member 30, as best seen in FIGS. 12 and 13, or be formed by the lower edge of engagement member 30, as best seen in FIGS. 14 and 15. This annular protrusion 49 and decoupling ledge 50 will herein be referred to as a "decoupling point" 51. This decoupling point 51 serves to increase the ease of eversion of receptacle 10 by ensuring the buckle point 26 occurs in the desired location. Additionally, in the case of negative internal pressure within receptacle 10 due to external suction, or the evacuation of liquid, the decoupling point 51 can serve as a means to reduce internal volume thereby equalizing pressure without the need to draw external air volume into receptacle 10. This quality is particularly useful in the nursing bottle application because no venting between the inside and outside of receptacle 10 is required for fluid delivery, although external venting could be used. The decoupling point 51 location and number can vary based on bottle height and diameter. This decoupling point 51 is particularly important for bottles with a diameter to height ratio (diameter/height) of less than 1. Containment holding protrusions 52 can also be included on attachment member 30, as shown in FIG. 13. The containment holding protrusions can create an interference fit between attachment member 30 and second surface 12*b* of receptacle 10. Containment holding protrusions 52 would typically, but not necessarily, extend 1 millimeters (mm) to 5 millimeters (mm), inclusively, from the attachment member surface. Additionally, these containment holding protrusions could also be included on second surface 12*b* of receptacle 10. It should be recognized by those skilled in the art that a continuous or discontinuous protrusion extending along a periphery of the surface 12*b* of the sidewall 12 can create and define a corresponding change in wall thickness and/or a corresponding localized change in Young's modulus, either of which can be referred to herein as a "buckle point" or "buckle region" of the container or receptacle. In other words, a continuous or discontinuous protrusion extending along a periphery of the surface 12*b* of the sidewall 12 can by definition be a "buckle point" or "buckle region" even when the wall thickness is otherwise considered constant thickness and/or even when the Young's modulus is otherwise considered constant.

The receptacle 10 can include stability lip 54, as best seen in FIGS. 14 and 15. The term "stability lip" 54, as used herein, can be defined as an outward protrusion along end wall 20. Stability lip 54 can be used to reduce the tendency of the receptacle 10 to unexpectedly fall over, for example, while resting on an uneven surface or when disturbed by outside forces.

Figure 1A:
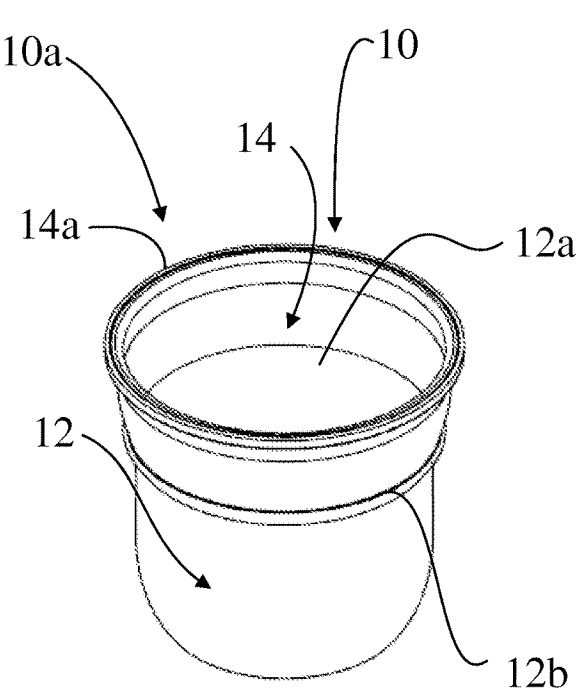
FIG. 1A is a perspective view of a receptacle in a first stable conformation prior to undergoing eversion.
Figure 2:
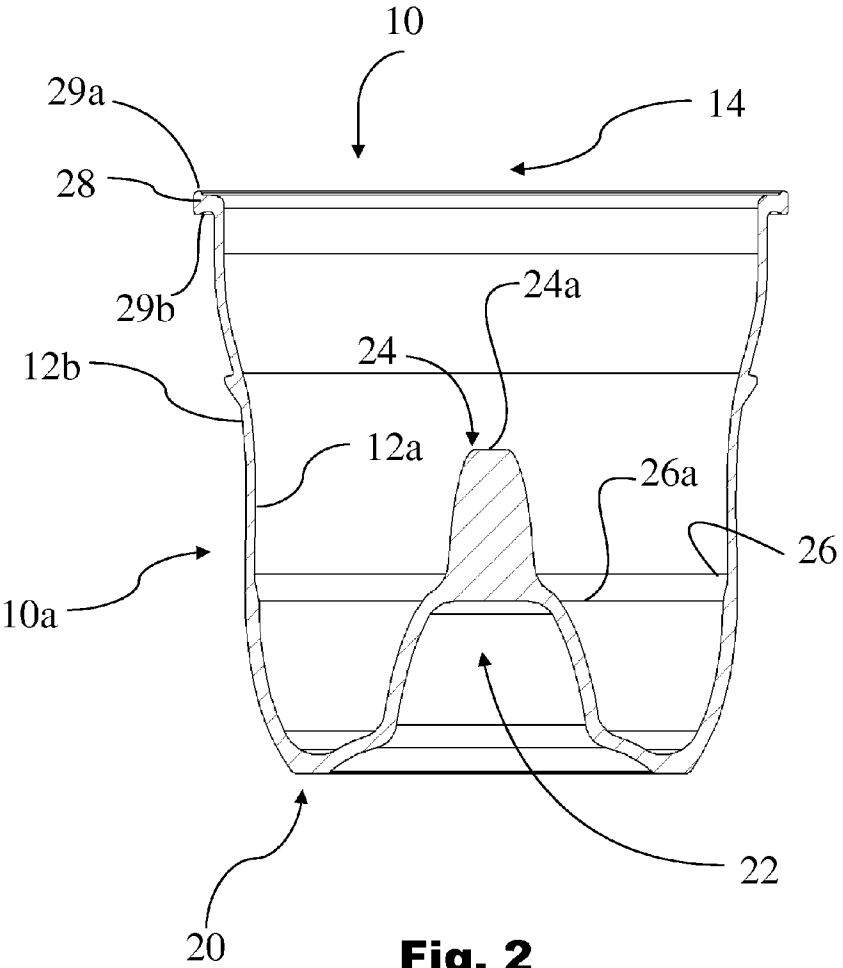
FIG. 2 is a longitudinal cross-sectional view of the receptacle of FIG. 1A in the first stable conformation.
Figure 5:
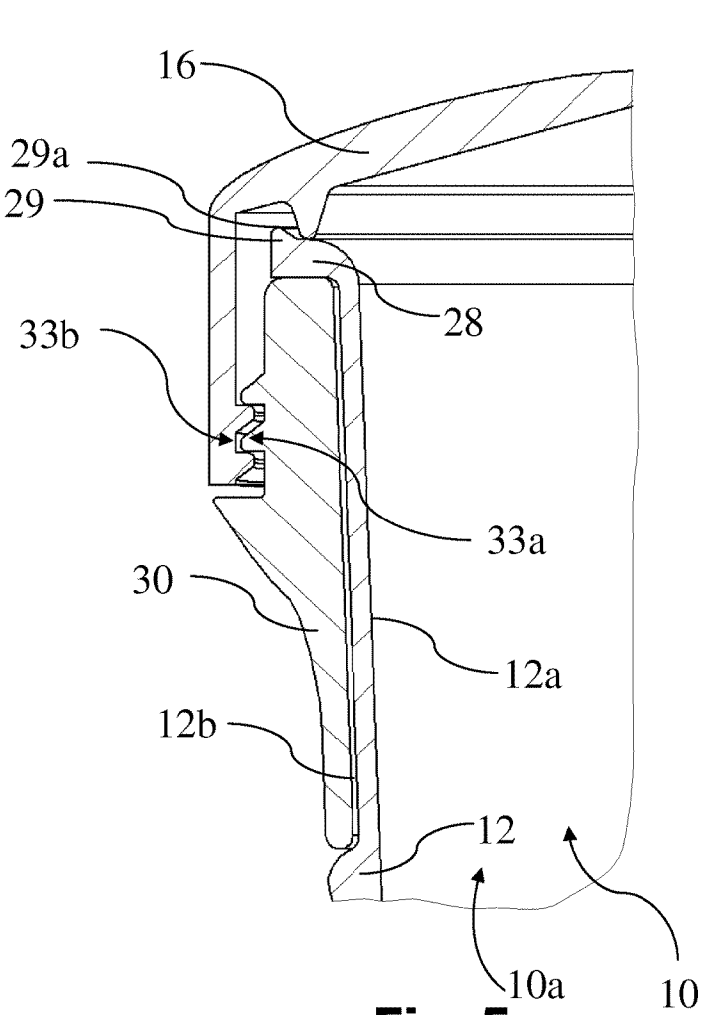
FIG. 5 is a cross-sectional view of a modified version of the attachment member of FIG. 7.
Figure 4:
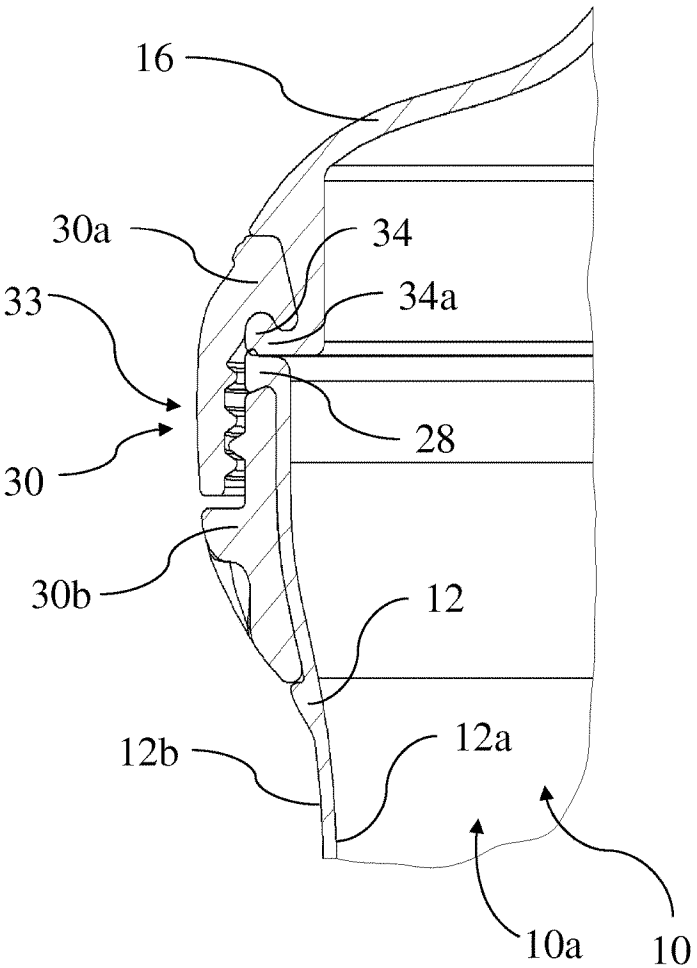
FIG. 4 is a cross-section of the attachment member of FIG. 3.

The receptacle 10 can include an annular engagement lip 28, as best seen in FIGS. 2 and 4. The term "engagement lip" 28, as used herein, can be defined to refer to an outward protrusion 28 around the perimeter 14*a*, as best seen in FIG. 1A, of the open end 14 of the receptacle 10. The engagement lip 28 can assist in securing an attachment member 30 to the receptacle sidewall 12. The engagement lip 28 can additionally include a sealing lip 29 as best seen in FIG. 5. The term "sealing lip" 29, as used herein, can be defined to refer to an upward protrusion 29*a*, or downward protrusion 29*b* around the perimeter of the engagement lip 28. The sealing lip 29 can tend to cause increased pressure between a capping element 16 and the open end 14 of the receptacle 10, when an attachment member 30 is engaged. An annular flange 34 can be provided on a capping element 16. The term "annular flange" 34 as used herein, can be defined to refer to a ring-shaped protrusion 34*a* around the base of the capping element 16 which holds an attachment member 30 in position to effect reversible attachment of a capping element 16 to the receptacle 10.

The receptacle 10 can include an open end 14 defined by one or more sidewalls 12, and an end wall 20, wherein a thickness of the end wall 20 is greater than a thickness of the sidewall 12. By way of example and not limitation, a thickness of the end wall 20 can be approximately 2 millimeters (mm) and a thickness of the sidewall can be approximately 1.5 millimeters (mm). In other words, the buckle point 26 or region 26*a* can include a first wall thickness of approximately 1.5 millimeter (mm), and other portions of the containment walls include a second wall thickness of at least approximately 2 millimeter (mm). Alternatively, the buckle point 26 or area 26*a* can be defined by a region of the containment wall having a first Young's modulus less than a second Young's modulus of other portions of the containment wall.

The receptacle 10 can be configured to enclose a beverage. When in a first stable conformation 10*a*, a first surface 12*a* of the receptacle 10 can face inwardly toward an interior of the receptacle 10. When in a second stable conformation 10*b*, the first surface 12*a* can face outwardly toward an exterior of the receptacle 10 to be particularly amenable to cleaning and drying after eversion of the receptacle 10 from the first stable conformation 10*a* (as best seen in FIG. 1A) to a second stable conformation 10*b* (as best seen in FIG. 1C). The first stable conformation was referred to above as the material holding conformation, and can also be referred to as the normal stable conformation. The second stable conformation was referred to above as the everted conformation, and can also be referred to as the everted stable conformation. By way of example and not limitation, the receptacle 10 can be made in the form of a nursing bottle, or other beverage container for general beverage storing or drinking use. The eversion of the receptacle 10 can facilitate cleaning milk, baby formula, protein powder, or other liquid or solid beverage residues from the beverage contacting surface 12*a* of the receptacle 10.

Figure 1B:
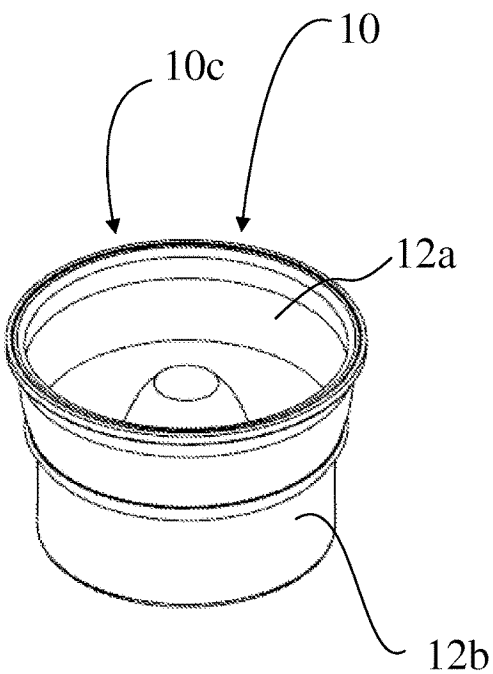
FIG. 1B is a perspective view of a receptacle undergoing eversion.

Referring now to FIGS. 1A-1C, a receptacle 10 is illustrated undergoing reversible eversion, between a first stable conformation 10*a* and a second stable conformation 10*b*. By way of example and not limitation, FIG. 1B illustrates a possible eversion midpoint 10*c*, between a normal use first stable conformation 10*a* shown in FIG. 1A and complete eversion stable conformation 10*b* shown in FIG. 1C used for cleaning and drying. The possible eversion midpoint 10*c* demonstrates a possible manner of eversion, but does not imply a required direction, sequence, or manner of the manual eversion process. The receptacle 10 includes a sidewall 12 defining an open end 14. The sidewall 12 can include a contained substance-contacting surface 12*a* and a non-contacting surface 12*b*. In the first stable conformation 10*a*, the contained substance-contacting surface 12*a* faces inwardly toward an interior of the receptacle 10, while the non-contacting surface 12*b* faces outward. In the second stable conformation 10*b*, the contained substance-contacting surface 12*a* faces outward and the non-contacting surface 12*b* faces inwardly toward an interior of the receptacle 10.

Referring now to FIG. 2, a cross-section of sidewall 12 is illustrated. The receptacle 10 can include an end wall 20. The end wall 20 can include an indentation 22, by way of example and not limitation, such as of conical shape. The sidewall 12 can include a buckle point 26, an engagement lip 28, and sealing lip 29.

Figure 3:
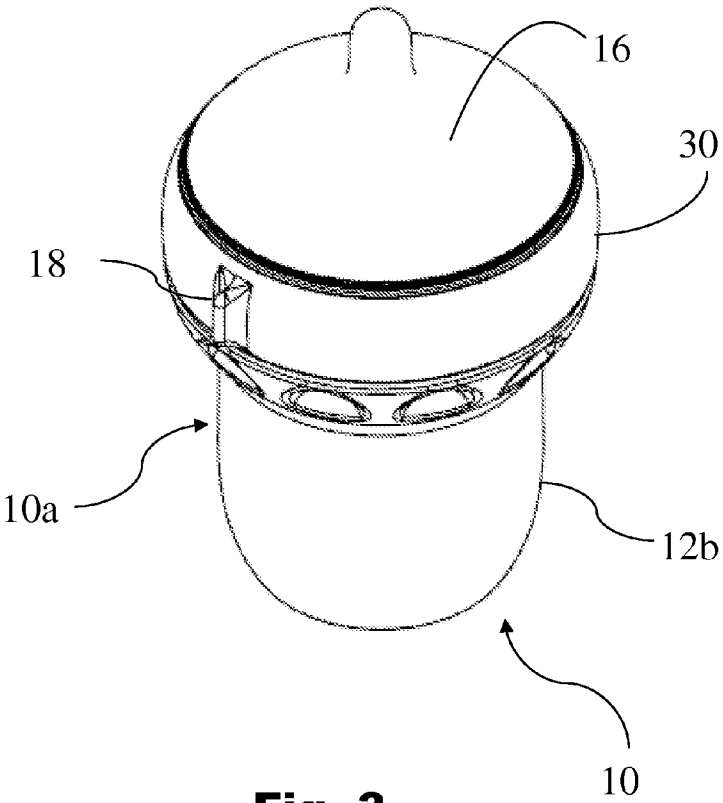
FIG. 3 is a perspective view of a nursing bottle including a containment element, a nipple-shaped capping element, and an attachment member having two sleeves.

Referring now to FIG. 3, by way of example and not limitation, the receptacle 10 can be made in the form of a nursing bottle 10. The receptacle 10 can include a capping element 16 and an attachment member 30. The capping element 16 can be formed in the shaped of a nipple. Alternatively, the capping element 16 can be formed in the shape of a disk, a cylinder, or any other shape which would serve the purpose of inhibiting exit of contained material from the receptacle 10. FIG. 3 additionally illustrates a protrusion 18 on the capping element 16 to help in taking the cap element 16 on and off from the receptacle 10. The protrusion 18 illustrated in FIG. 3 is incorporated into the attachment member 30. Additionally, receptacle 10 can include an optional one-way valve to diminish negative pressure inside the receptacle created as receptacle contents are evacuated, and can alternatively be incorporated into a receptacle sidewall 12, end wall 20, indentation 22, or capping element 16.

Referring now to FIG. 4, a longitudinal detailed cross-section view of the receptacle 10 of FIG. 2 is illustrated. By way of example and not limitation, as illustrated in FIG. 4, the attachment member 30 can include two sleeves 30*a*, 30*b* with complementary threading 33. One sleeve 30*b* can engage with the receptacle 10, while the other sleeve 30*a* can engage the capping element 16.

Alternatively, as illustrated in FIG. 5, the attachment member 30 can include a single threaded sleeve, wherein the threading 33*a* on the attachment member 30 is complementary to threading 33*b* on the capping element 16. Still referring to FIG. 5, the attachment member 30 can include a single threaded sleeve, which includes threading 33*a*, the threading 33*a* being complementary to threading 33*b* which is directly molded onto the capping element 16.

Referring now to FIG. 6, a detailed cross section view of the sidewall 12 of the receptacle 10 is shown. The illustrated area depicts a buckle point 26 in the sidewall 12. The buckle point 26 can be approximately 1.5 millimeters (mm) thick, while other regions of sidewall 12 can be approximately 2 mm thick. In other embodiments, buckle point 26 can have a first Young's modulus less than a second Young's modulus of other regions of sidewall 12. The buckle point 26 can extend along an entire periphery or perimeter of the receptacle 10 to define a buckle region 26*a*.

Figure 7:
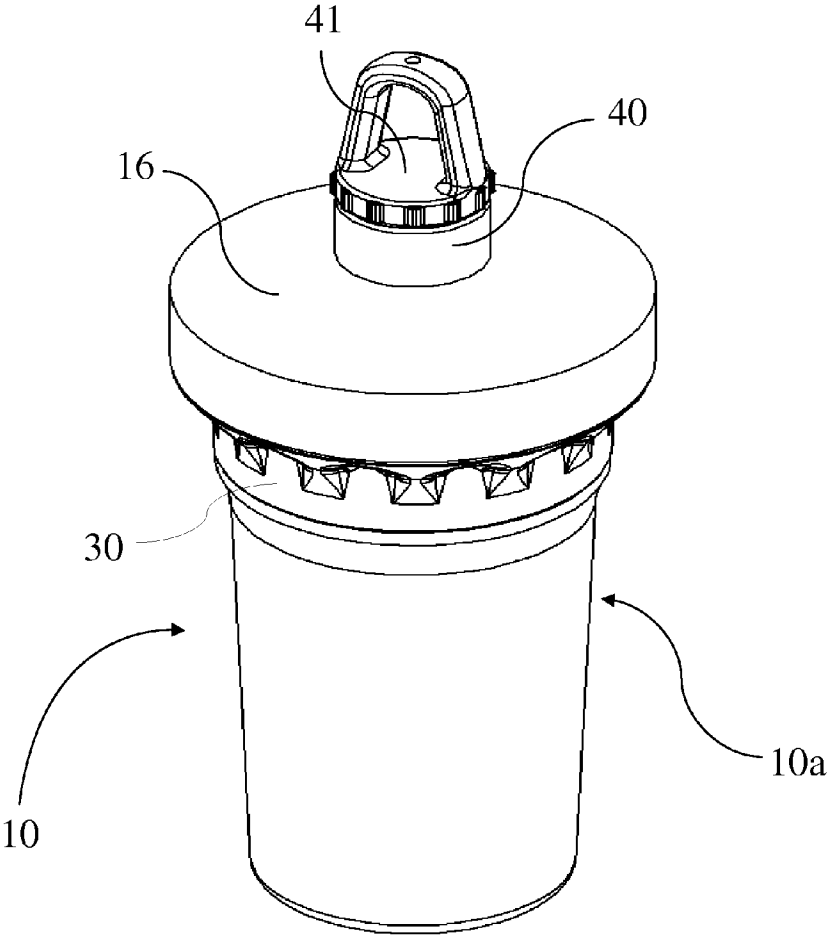
FIG. 7 is a perspective view of a general use bottle including a containment element, a rigid cap with an optional protruding aperture and reversible aperture cover, and an attachment member having one sleeve.

Referring now to FIG. 7, the receptacle 10 is illustrated in a first stable conformation 10*a* with an attachment member 30, and a capping element 16 composed substantially of rigid material. The capping element 16 can include a protruding passage 40 defining an aperture and a removable cap 41. The protruding passage 40 can serve as an exit point for receptacle contents, for example for drinking a beverage from the receptacle. The removable cap 41 can serve to reversibly cover the protruding passage 40 to thereby reversibly prevent evacuation of receptacle contents.

Referring again to FIGS. 3-4, the capping element 16 can have a nipple shaped surface with an outwardly projecting annular flange portion. An attachment member can include a first rigid sleeve 30*a* having an inwardly-facing threaded portion 33 adjacent one end. The first rigid sleeve can be of a size to encircle the nipple shaped surface while engaging with the annular flange portion of the capping element 16 and fit over the open end 14 of the containment element 10. A second rigid sleeve 30*b* can have an outwardly-facing complementary threaded portion 33 and can be of a size to be fit within the threaded portion 33 of the first sleeve 30*a*, such that when the threaded portions 33 of the first and second sleeves 30*a*, 30*b* are juxtaposed with respect to one another, and the threaded portions 33 of the first and second sleeves 30*a*, 30*b* are engaged and tightened via rotary displacement, a fluid tight seal is formed between the annular flange portion of the capping element 16 and the open end 14 of the containment element 10.

Referring to FIGS. 7-8, the capping element 16 can have a rigid body with a first threaded portion. A protruding passage 40 can define an aperture formed in the rigid body. A cover element 41 can be provided for reversibly covering the protruding passage 40 defining the aperture. The covering element 41 can be attached to the capping element 16. An attachment member 30 can have a rigid sleeve with a second threaded portion 33*b* complementary to the first threaded portion 33*a*. The sleeve can be of a size to fit over the open end of the containment element, such that when the threaded portions of the capping element 16 and attachment member 30 are engaged and tightened via rotary displacement, the capping element 16 and the open end 14 of the containment element 10 are reversibly brought into contact.

Referring now to FIG. 8, a detailed longitudinal cross-sectional view of sidewall 12 of the receptacle of FIG. 7 is illustrated. The receptacle sidewall 12 can include inserts 45 of rigid material. As used herein, the phrase "inserts of rigid material" can be defined as referring to annular inserts of material, fully embedded within the receptacle sidewall 12, and composed substantially of material which is rigid or semi-rigid as defined above. Such rigid inserts can improve the structural stability of receptacle 10 when in stable conformation 10*a*. It should be recognized that inserts 45 can be used in the sidewall 12 of any configuration of the receptacle 10, and are not limited to use in the specific sidewall configuration illustrated in FIGS. 7 and 8.

Figure 9:
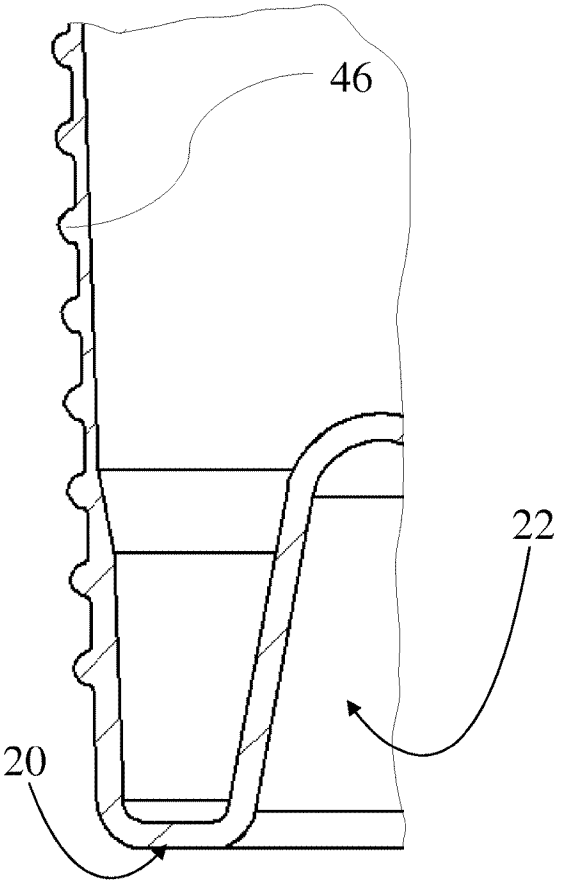
FIG. 9 is a cross sectional view of the receptacle of FIG. 7 additionally including molded ridges in the receptacle sidewall.

Referring now to FIG. 9, a detailed longitudinal cross-sectional view of sidewall 12 of a receptacle 10 is depicted. The receptacle sidewall 12 can include sidewall ridges 46. The phrase "sidewall ridges" as used herein can be defined to refer to annular regions of increased sidewall thickness, relative to other portions of the sidewall 12, and which are substantially parallel to the perimeter 14*a* of the open end 14 of the receptacle 10. The sidewall ridges 46 can improve the structural stability of receptacle 10 when in the stable conformation 10*a*, or can facilitate holding of receptacle 10. It should be recognized that the sidewall ridges 46 can be used in the sidewall 12 of any configuration of the receptacle 10 and is not limited to use in the specific sidewall configuration illustrated in FIG. 9.

Referring now to FIGS. 10-12, a perspective view, a cross sectional view, and a detailed cross sectional view, respectively, of an additional embodiment of a general use bottle, similar to the general use bottle of FIG. 7, is depicted. In this embodiment, the attachment member 30, with threaded portion 33*b* complementary to the first threaded portion 33*a*, seen clearly in FIGS. 5 and 7, is extended to include "eversion cutouts" 48 and "containment element pull down cutouts" 47, as best seen in FIG. 10, and decoupling ledge 50 with continuous annular protrusion 49*a* to form decoupling point 51 at buckle point 26, as best seen in FIG. 12. Decoupling point 51 ensures that buckling occurs at the desired buckle point 26 rather than elsewhere on the bottle, increasing ease of eversion. In this same embodiment, eversion cutouts 48 can also be used so the user can continue to everse containment element 10 upwardly towards the open end 14 of the receptacle, as in FIG. 1A-1B, by reaching through eversion cutout(s) 48 and pushing containment element 10. To insert containment element 10 back into attachment member 30, containment element pull down cutouts 47 can also be included such that the user can grab and pull containment element 10 downward, until containment element 10 is secured into attachment member 30 via opposing forces created at the decoupling ledge 50 with continuous annular protrusion 49*a* and engagement lip 28, as seen in FIG. 5.

Referring now to FIG. 13, a cross-sectional view of extended attachment member 30, similar to the attachment member 30 shown in FIG. 10, is depicted. Containment holding protrusions 52 can also be included on attachment member 30. The containment holding protrusions create an interference fit between attachment member 30 and second surface 12*b* of receptacle 10. These can be used to more securely hold containment element 10 with respect to attachment member 30. Containment holding protrusions 52 would typically, but not necessarily, extend 1 millimeter (mm) to 5 millimeter (mm), inclusively, from the attachment member surface. Additionally, these containment holding protrusions could also be included on second surface 12*b* of receptacle 10 or on only second surface 12*b* of receptacle 10.

Referring now to FIGS. 14-15, a perspective view and a cross sectional view, respectively, of an additional embodiment of a nursing bottle is provided. In this embodiment, the attachment member 30, with threaded portion 33*b* complementary to the first threaded portion 33*a*, seen clearly in FIG. 5, is extended to include "containment element pull down cutouts" 47, as best seen in FIG. 14, and decoupling ledge 50 with discontinuous annular protrusion 49*b* to form decoupling point 51 at buckle point 26, as best seen in FIG. 15. Also included in this embodiment is a stability lip 54. Stability lip 54 can be used to reduce the tendency of the receptacle to unexpectedly fall over, for example while resting on an uneven surface or when disturbed by outside forces.

Figure 17:
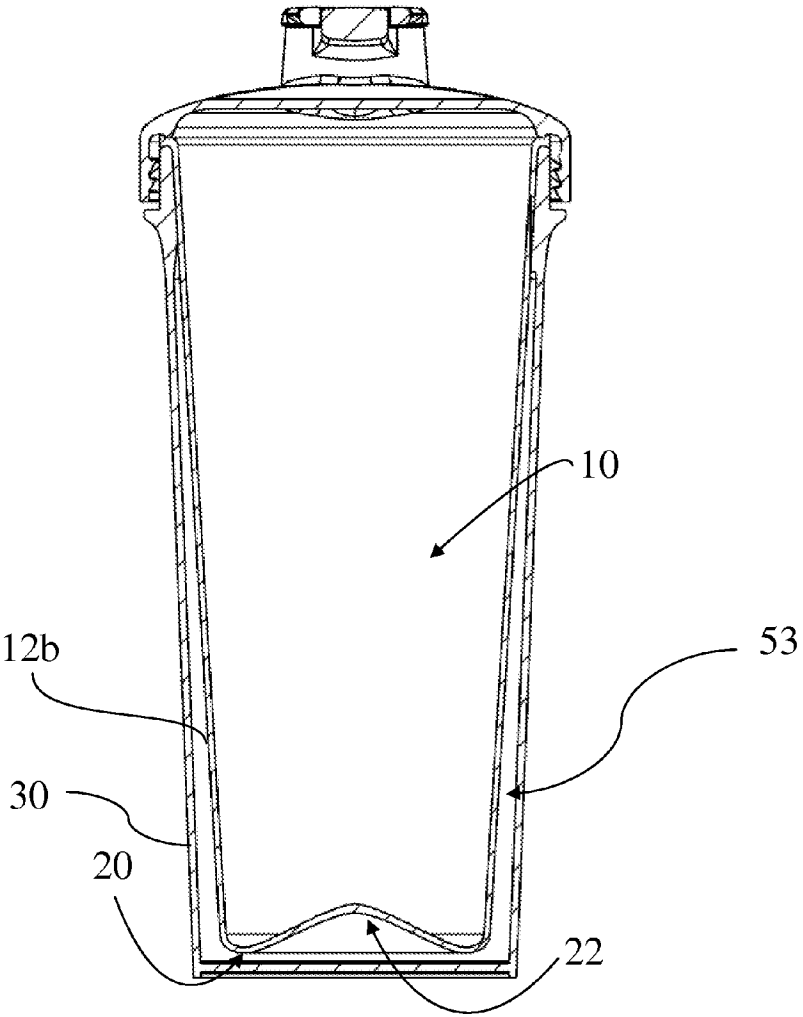
FIG. 17 is a cross-sectional view of the receptacle of FIG. 16 including a static air column between the containment element and attachment member.
Figure 16:
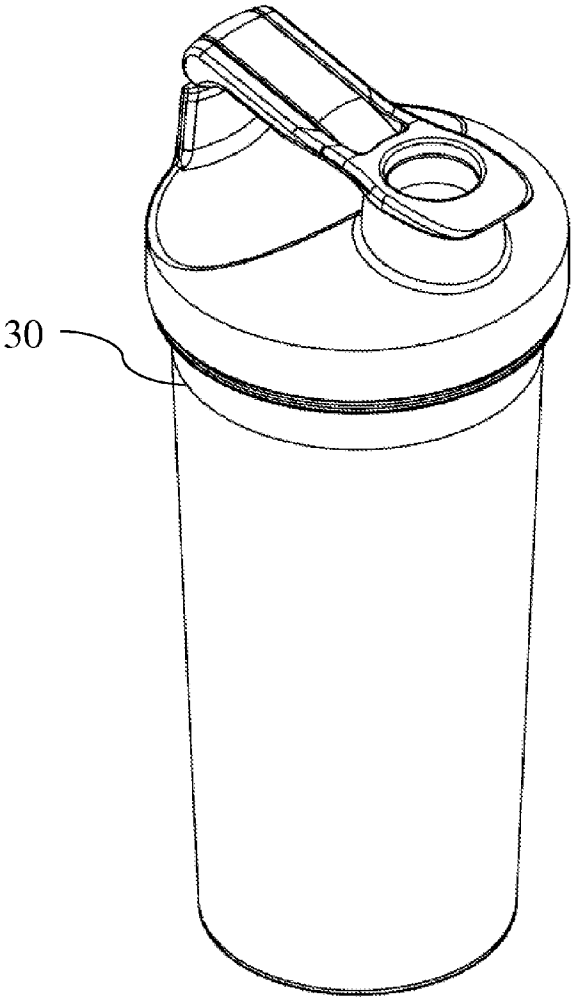
FIG. 16 is a perspective view of an additional embodiment of a general use bottle including a containment element, a rigid cap with an optional protruding aperture and reversible aperture cover, and an extended attachment member which can create a thermally insulative enclosure around the containment element.

Referring now to FIGS. 16-17, attachment member 30 can substantially or completely surround the non-containing surface 12*b*. There can also be a designed in air gap 53, typically, but not necessarily, between 2 millimeters (mm) and 5 millimeters (mm) in width, inclusive. This can create a thermally insulative enclosure around the containment element via a column of static air between non-containing surface 12*b* and attachment member 30. This serves to aid in maintaining the current temperature of the material being held by material contacting surface 12*a* and eliminate condensation from forming on the exterior surface of attachment member 30 when cold liquids are being stored in containment element 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A receptacle for containing a substance comprising:

at least one sidewall defining a container with a predetermined volume for housing the substance to be contained, the container having an open end and an end wall opposing the open end, the at least one sidewall including a first substance-contacting surface, the container being reversibly eversible, such that the container reversibly transforms between a first stable conformation with the substance-contacting surface facing inward and a second stable conformation with the substance-contacting surface facing outward; and a rigid sleeve having a top and a bottom, the bottom having a bottom edge surface that defines an opening in the rigid sleeve, the rigid sleeve at least partially sheathing the container and having at least one sidewall-pull-down cutout surface defining a sidewall-pull-down cutout, wherein the sidewall-pull-down cutout surface extends from the bottom edge surface of the rigid sleeve and toward the top allowing for a second surface of the sidewall to be exposed when in the first stable conformation, wherein the at least one sidewall can be accessed during eversion to facilitate interaction of the at least one sidewall with respect to the rigid sleeve;

wherein the at least one sidewall further includes at least one annular protrusion extending outward at least partially along the second surface of the sidewall at a location closer to the end wall than the open end;

the receptacle further comprising a decoupling ledge formed into the rigid sleeve, while in the normal stable conformation the annular protrusion of the container cooperates with the decoupling ledge of the rigid sleeve defining a buckle region between the annular protrusion and the end wall to facilitate deformation during eversion of the container.

2. The receptacle of claim 1 wherein the at least one sidewall is resilient and has sufficient yield strain to prevent permanent deformation and fatigue failure of a material of the at least one sidewall after repeated eversions.

3. The receptacle of claim 1, wherein the rigid sleeve further comprises:

at least one eversion cutout created in the rigid sleeve allowing for the second surface of the sidewall to be exposed, allowing pressure to be directly applied to the at least one sidewall through the rigid sleeve to additionally facilitate an eversion.

4. The receptacle of claim 1 further comprising:

An indentation formed in the end wall.

5. The receptacle of claim 1 further comprising:

a stability lip defined by the end wall extending outward at least partially beyond the second surface of the sidewall enhancing stability of the container on uneven surfaces.

6. The receptacle of claim 1 further comprising:

a capping element having an attachable surface to removably cover the open end of the container when in the normal stable conformation.

7. The receptacle of claim 1, wherein the at least one sidewall-pull-down cutout surface is a pair of opposing sidewall-pull-down cutout surfaces, each defining a respective sidewall-pulldown cutout.

8. A receptacle for containing a substance comprising:

at least one elastomeric sidewall defining a container having a first surface, an open end and an end wall opposing the open end, the container being reversibly eversible between a first stable conformation and a second stable conformation, the first stable conformation defined by the first surface facing inward and the second stable conformation defined by the first surface facing outward, the at least one elastomeric sidewall having resilience and sufficient yield strain to prevent permanent deformation and fatigue failure of the elastomeric sidewall after repeated eversions; and a rigid sleeve having a top and a bottom, the bottom having a bottom edge surface that defines an opening at the bottom of the rigid sleeve, the rigid sleeve at least partially sheathing the container and having at least one sidewall-pulldown cutout surface defining a sidewall-pulldown cutout, the at least one sidewall-pulldown cutout surface extending directly from the bottom edge surface and partially toward the top, and having at least one eversion cutout created in the rigid sleeve allowing for a second surface of the sidewall to be exposed when in the first stable conformation, wherein pressure can be directly applied to the at least one elastomeric sidewall to additionally facilitate removal from the rigid sleeve and eversion of the container;

wherein the sidewall further includes an annular protrusion extending outward at least partially along a periphery of the second surface of the sidewall at a location closer to the end wall than the open end;

the receptacle further comprising a decoupling ledge formed into the rigid sleeve, while in the normal stable conformation the annular protrusion of the container cooperates with the decoupling ledge of the rigid sleeve defining a buckle region between the annular protrusion and the end wall to facilitate deformation during eversion of the container.

9. The receptacle of claim 8 further comprising:

An indentation formed in the end wall.

10. The receptacle of claim 9 further comprising:

a stability lip defined by the end wall extending outward at least partially beyond the second surface of the sidewall enhancing stability of the container on uneven surfaces.

11. The receptacle of claim 8, wherein the at least one sidewall-pull-down cutout surface is a pair of opposing sidewall-pull-down cutout surfaces, each defining a respective sidewall-pulldown cutout.

* * * * *